US010662015B1

(12) United States Patent
Guerin

(10) Patent No.: US 10,662,015 B1
(45) Date of Patent: May 26, 2020

(54) COIL CLAMP

(71) Applicant: Phillip M. Guerin, Lawrence, MA (US)

(72) Inventor: Phillip M. Guerin, Lawrence, MA (US)

( * ) Notice: Subject to any disclaimer, the term of this patent is extended or adjusted under 35 U.S.C. 154(b) by 212 days.

(21) Appl. No.: 15/949,630

(22) Filed: Apr. 10, 2018

(51) Int. Cl.
*B65H 16/02* (2006.01)
*B65H 35/06* (2006.01)
*B65H 16/00* (2006.01)

(52) U.S. Cl.
CPC ..... *B65H 16/028* (2013.01); *B65H 16/005* (2013.01); *B65H 35/06* (2013.01)

(58) Field of Classification Search
CPC .... B65H 16/028; B65H 16/005; B65H 16/02; B65H 2701/173; B65H 16/06; B65H 16/04; B65H 16/08; B65H 75/08; B65H 75/14; B65H 75/146; B65H 75/148; A47K 10/38; A47K 10/3827
See application file for complete search history.

(56) References Cited

U.S. PATENT DOCUMENTS 1,390,632 A * 9/1921 Metzger ..... A47F 7/17 312/34.23
1,981,590 A * 11/1934 Easterling ..... B65H 35/0006 225/47
2,483,522 A * 10/1949 Bovee ..... B42D 19/00 281/6
4,094,473 A * 6/1978 Salvino ..... B65H 16/02 242/595
4,211,374 A * 7/1980 Salvino ..... B65H 75/02 242/595.1
4,467,974 A 8/1984 Crim
5,829,710 A * 11/1998 Halle ..... B65H 16/005 242/595.1
6,062,386 A * 5/2000 Inoue ..... B23K 9/1333 206/397
D653,887 S 2/2012 Guerin
8,287,019 B1 10/2012 Guerin
8,287,020 B1 * 10/2012 Guerin ..... A45F 5/10 294/148
9,027,868 B2 * 5/2015 Guerin ..... E04D 15/06 242/422.6
2004/0102870 A1 * 5/2004 Andersen ..... B65H 18/28 700/215
2007/0272362 A1 * 11/2007 Peterson ..... B65H 37/002 156/764

(Continued)

*Primary Examiner* — Michael E Gallion
(74) *Attorney, Agent, or Firm* — David M. Driscoll

(57) ABSTRACT

A device for holding a coil structure that is wound in multiple coils. The device includes a coil clamp that retains the coil structure and a base substrate that the coil clamp engages in order to support the coil clamp and, in turn, the coil structure. The coil clamp is formed as a single piece coil clamp that includes a main circular portion and a base substrate engagement portion that is contiguous with the main circular portion. The main circular portion is arranged for receipt of the coil structure, and said base substrate engagement portion has a retaining recess for receiving and engaging with a side edge of the base substrate. The container box is preferably constructed of a cardboard material, and a part, or all of, the container box, is foldable and useable as the base substrate.

23 Claims, 9 Drawing Sheets

(56) References Cited

U.S. PATENT DOCUMENTS

| | | | | |
|---|---|---|---|---|
| 2008/0265084 | A1* | 10/2008 | Hammer | B65H 16/005 242/557 |
| 2016/0374522 | A1* | 12/2016 | Sherrill | B65H 16/005 225/77 |
| 2018/0079612 | A1* | 3/2018 | Guerin | B65H 16/005 |

* cited by examiner

COIL CLAMP

FIELD OF THE INVENTION

The present invention relates in general to an apparatus or device for holding or clamping a coil structure. More particularly, the present invention pertains to a coil clamp for holding or retaining a metal coil structure that is wound in multiple coils. Even more particularly, the present invention pertains to a coil clamp formed as a single piece coil clamp that includes a main circular portion and a base substrate engagement portion that is contiguous with the main circular portion. The device of the present invention preferably is of a minimum width and is centered along the metal coil structure, although in an alternate embodiment of the present invention a pair of spaced apart coil clamps may be used to support the metal coil structure.

BACKGROUND OF THE INVENTION

There presently exist different forms of coil holders or dispensers. Generally speaking the existing devices are too complex in structure and there is a present need for more simplified device, but one that is effective in holding the coil structure in position to thus enable a length of the coil structure to be withdrawn and separated from the coil structure. As a matter of fact the present Applicant has existing patents pertaining to coil dispensers including D653,887; 8,287,019; 8,287,020; and 9,027,868. Although the devices shown in these patents are very effective for their intended use, the intent of the present invention is to provide an improvement particularly directed toward simplifying the holder or dispenser device. Other more complex structures are shown in U.S. Pat. Nos. 2,483,522 and 5,829,710.

Accordingly, it is an object of the present invention to provide an improved coil clamp which is particularly of simplified construction and that is yet effective in holding the coil structure in position to thus enable a length of the coil structure to be withdrawn and separated from the coil structure.

Another object of the present invention is to provide an improved coil clamp that is in the form of a single piece coil clamp that includes a main circular portion and a base substrate engagement portion that is contiguous with the main circular portion.

Still another object of the present invention is to provide an improved coil clamp that is housed in a cardboard box, or the like, and in which the box structure itself functions as the base substrate.

SUMMARY OF THE INVENTION

To accomplish the foregoing and other objects, features and advantages of the present invention there is provided a device for holding a coil structure that is wound in multiple coils. The device comprises a coil clamp that retains the coil structure and a base substrate that the coil clamp engages in order to support the coil clamp and, in turn, the coil structure. The coil clamp is formed as a single piece coil clamp that includes a main circular portion and a base substrate engagement portion that is contiguous with the main circular portion. The main circular portion is constructed and arranged for receipt of the coil structure, and the base substrate engagement portion has a retaining recess for receiving and engaging with a side edge of the base substrate.

In accordance with other aspects of the present invention the base substrate is a piece of planar material; the planar material is a cardboard material; the main circular portion of the single piece coil clamp has an end free edge; the end free edge of the main circular portion extends linearly and is disposed spaced above the base substrate when the retaining recess is engaged with an edge of the base substrate; the end free edge of the main circular portion is located opposite to the base substrate engagement portion and forms an open slot through which an edge of the coil structure can be withdrawn in unwinding the coil structure; the base substrate engagement portion is formed by opposite position legs that define the retaining recess for receiving and engaging with the side edge of the base substrate; the opposite position legs include an upper leg that is contiguous with the main circular portion and a lower leg having a free end edge that extends toward the end free edge of the main circular portion; the base substrate engagement portion further includes a first arcuate portion integrally connecting the upper and lower legs and a second arcuate portion integrally connecting the upper leg and the main circular portion; the first arcuate portion turns in an opposite direction to the second arcuate portion; the first arcuate portion has a smaller radius of curvature than that of the second arcuate portion.

In accordance with still further aspects of the present invention the device is associated with a box for initially holding the coil structure; the box is constructed of a cardboard material; a part, or all of the box, is foldable and useable as the base substrate; the base substrate further has an edge opposite to the edge that engages with the recess and upon which an and edge of the coil structure lies to enable a cutting of the end edge of the coil structure at a location over the opposite edge of the base substrate; and the base substrate engagement portion further includes a first arcuate portion integrally connecting the upper and lower legs and a second arcuate portion integrally connecting the upper leg and the main circular portion, wherein the first arcuate portion turns in an opposite direction to the second arcuate portion, and wherein the first arcuate portion has a smaller radius of curvature than that of the second arcuate portion.

BRIEF DESCRIPTION OF THE DRAWINGS

It should be understood that the drawings are provided for the purpose of illustration only and are not intended to define the limits of the disclosure. In the drawings depicting the present invention, all dimensions are to scale. The foregoing and other objects and advantages of the embodiments described herein will become apparent with reference to the following detailed description when taken in conjunction with the accompanying drawings in which.

DETAILED DESCRIPTION

Figure 1:
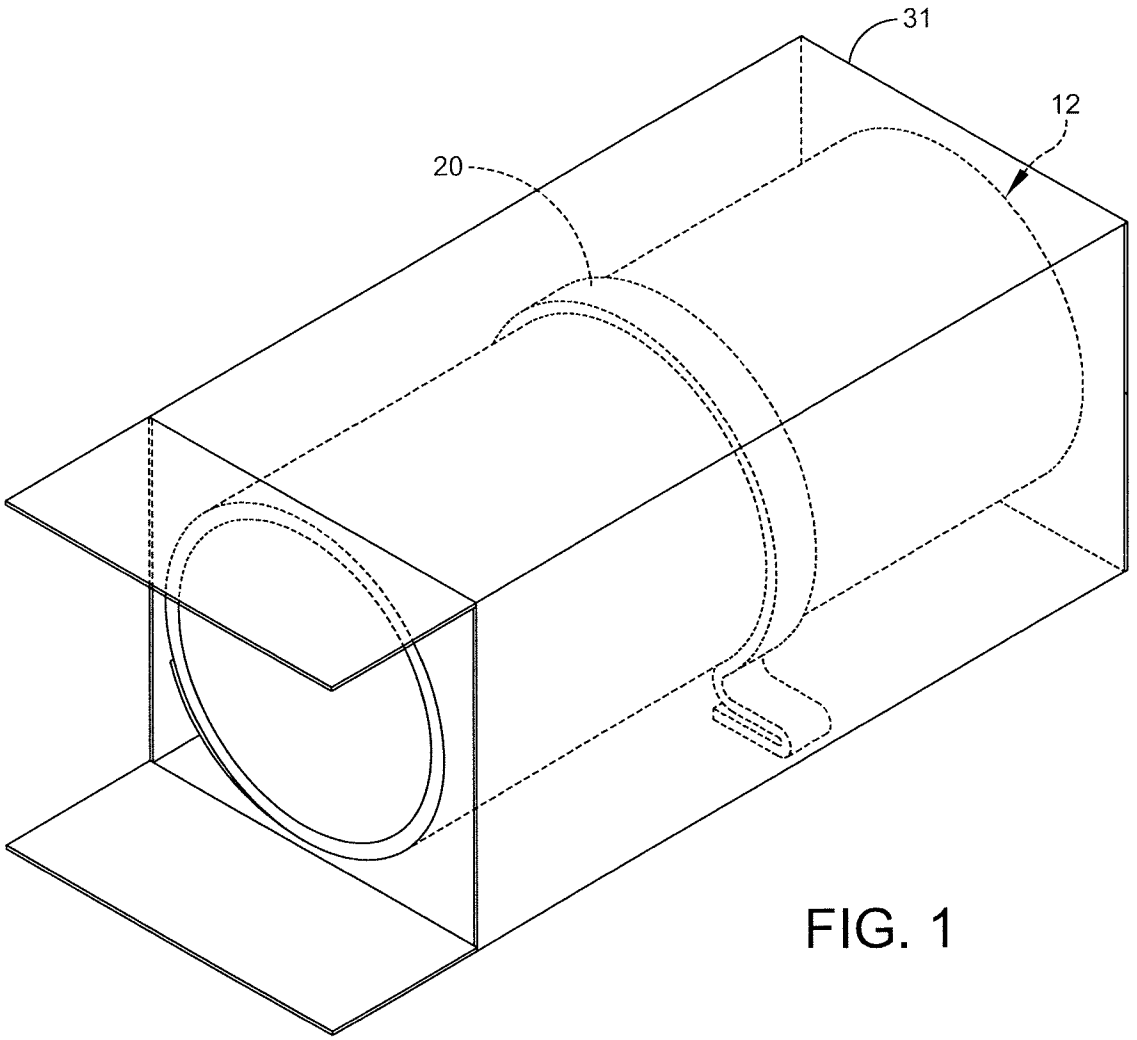
FIG. 1 is a perspective view of the coil clamp of the present invention as positioned within the container box and about the metal coil structure.
Figure 2:
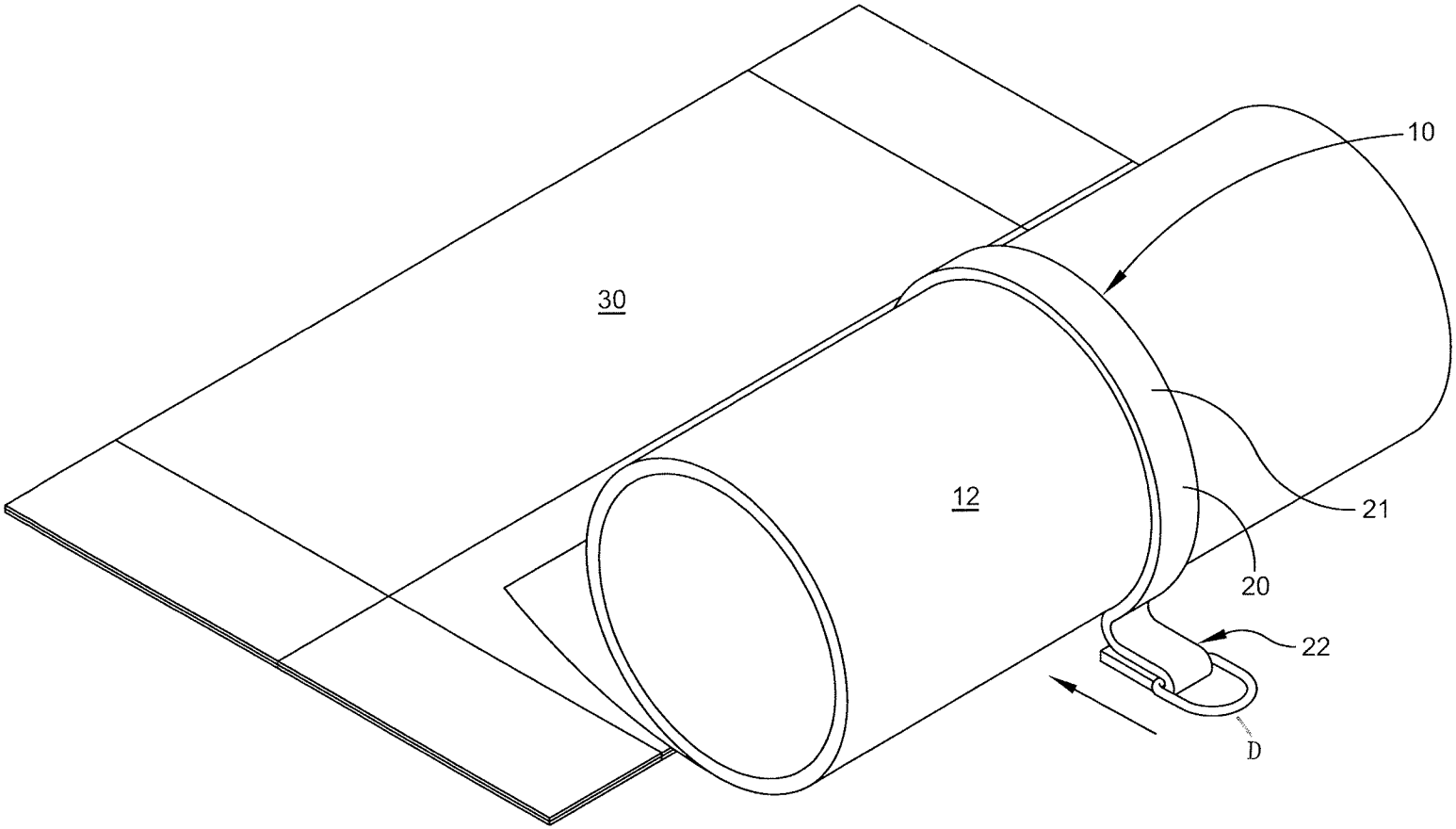
FIG. 2 is a perspective view of the metal coil having been removed from the container box with the coil clamp in position about the metal coil and with the container box flattened so as to be useable as a base substrate upon which the metal coil can be withdrawn and cut.
Figure 3:
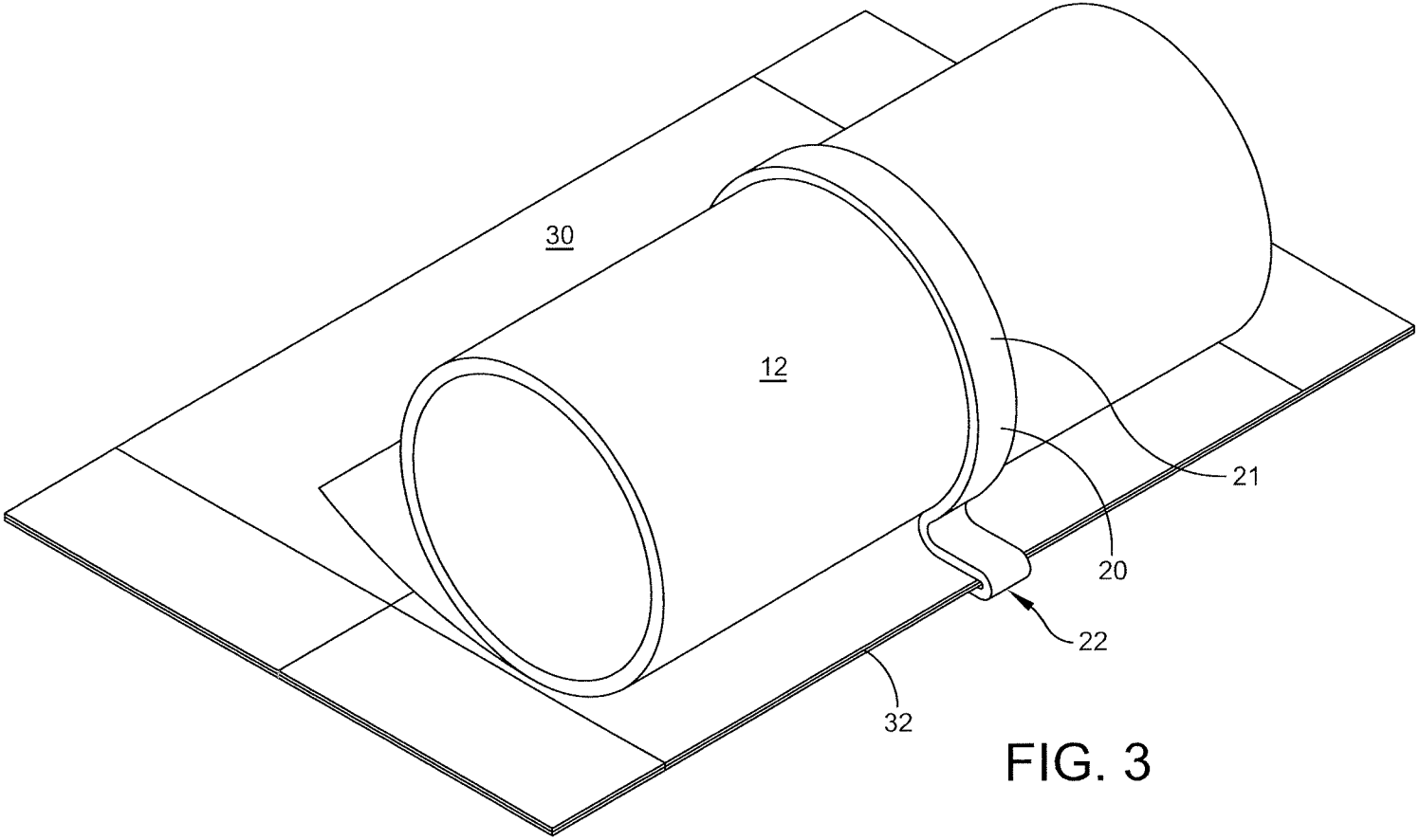
FIG. 3 is a perspective view of the metal coil having been removed from the container box with the coil clamp in position about the metal coil, with the container box flattened so as to be useable as a base substrate upon which the metal coil can be withdrawn and cut, and also illustrating the coil clamp engaged with an edge of the base substrate.
Figure 4:
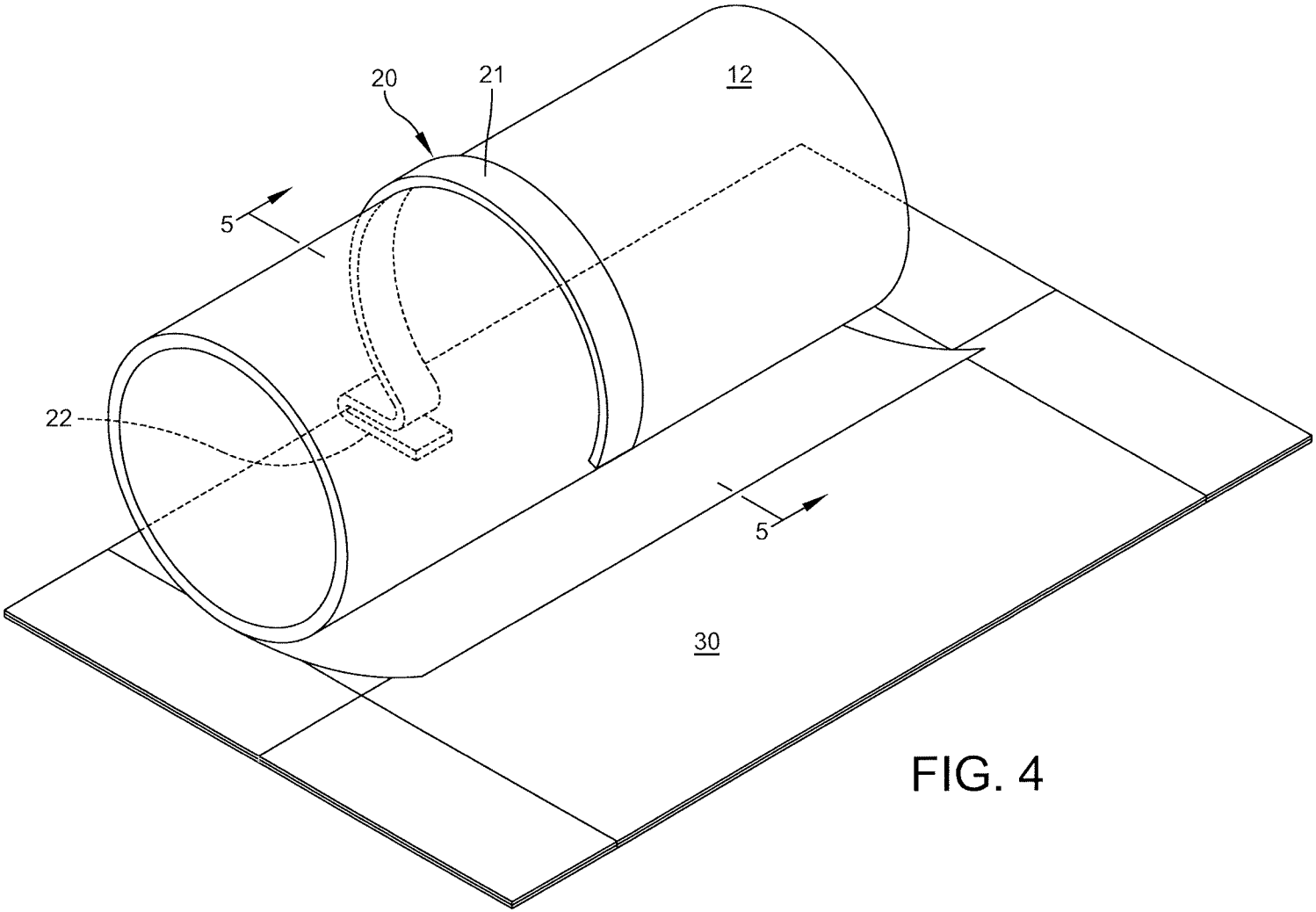
FIG. 4 is a perspective view taken from the opposite side with a section of the metal coil being withdrawn from the coil roll.
Figure 5:
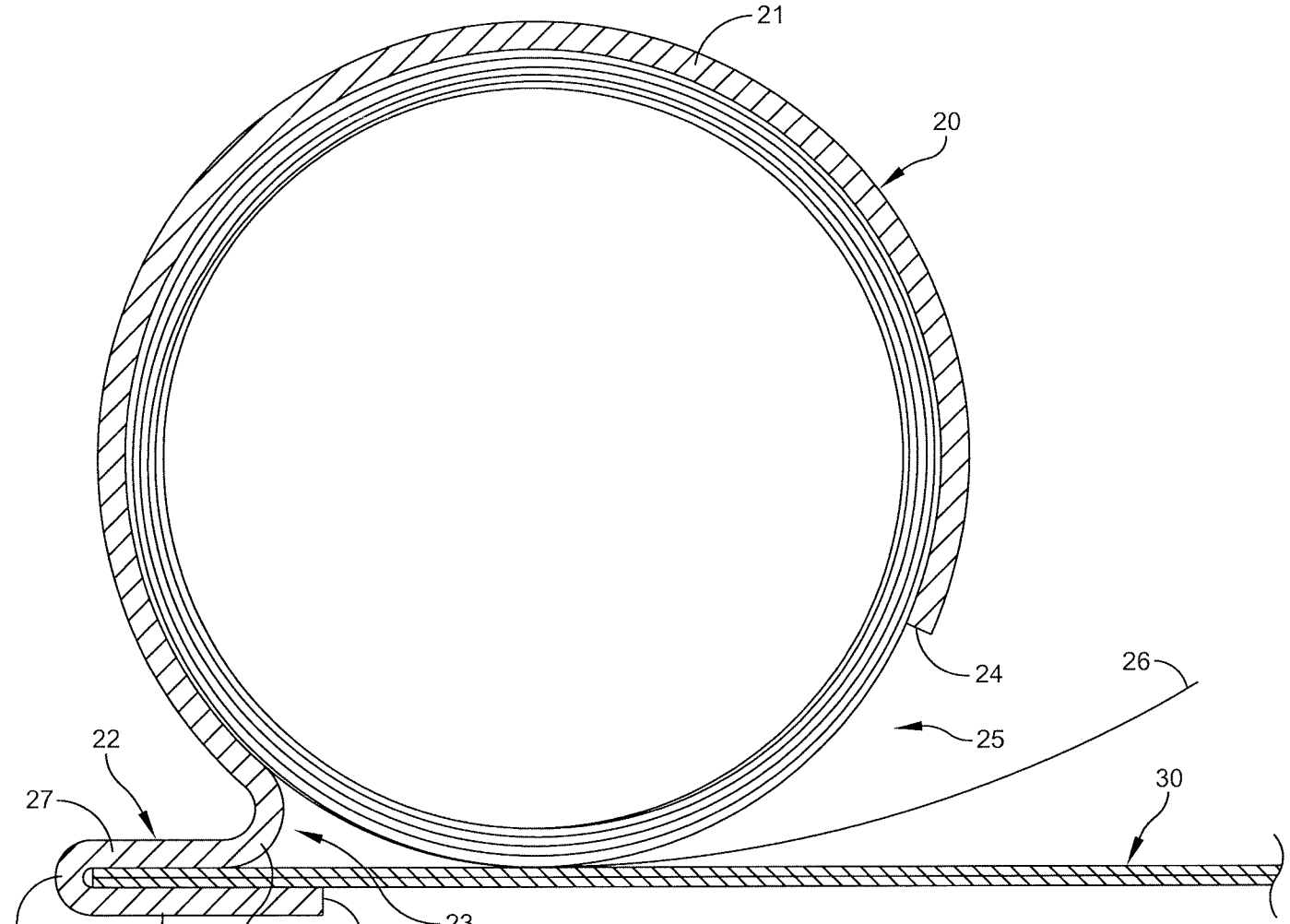
FIG. 5 is a cross-sectional through the coil clamp as taken along line 5-5 of FIG. 4.
Figure 6:
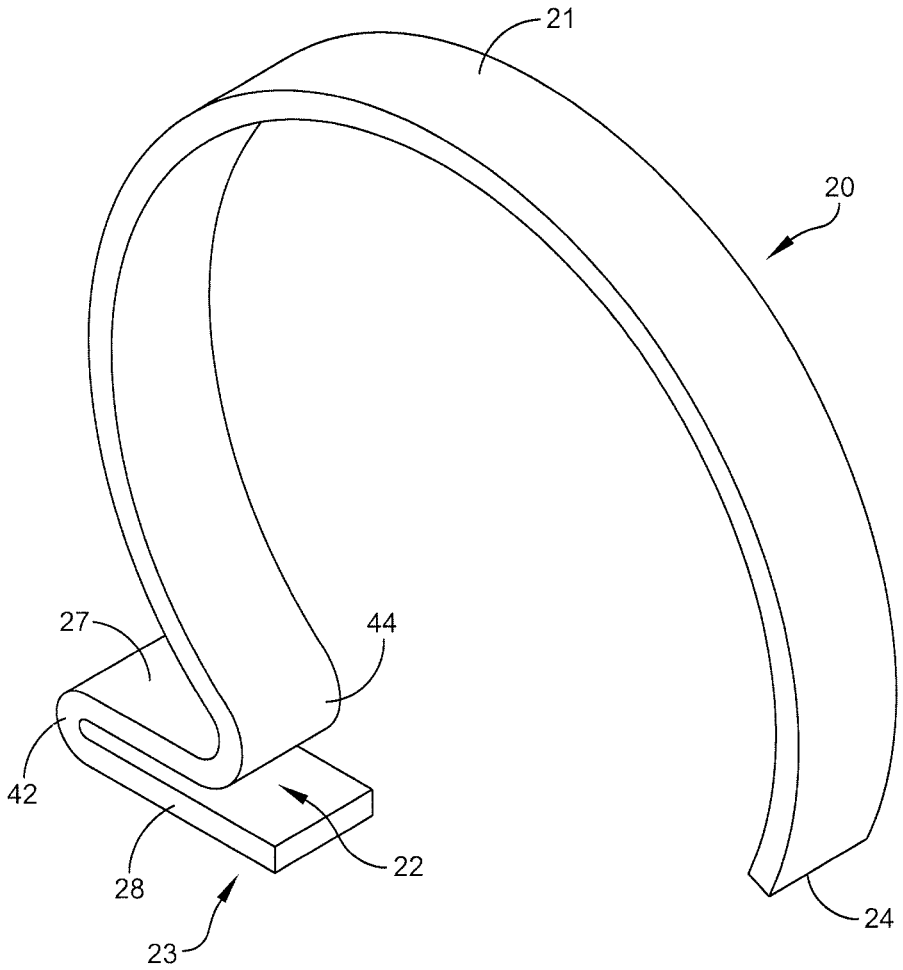
FIG. 6 is a perspective view showing the coil clamp alone.
Figure 7:
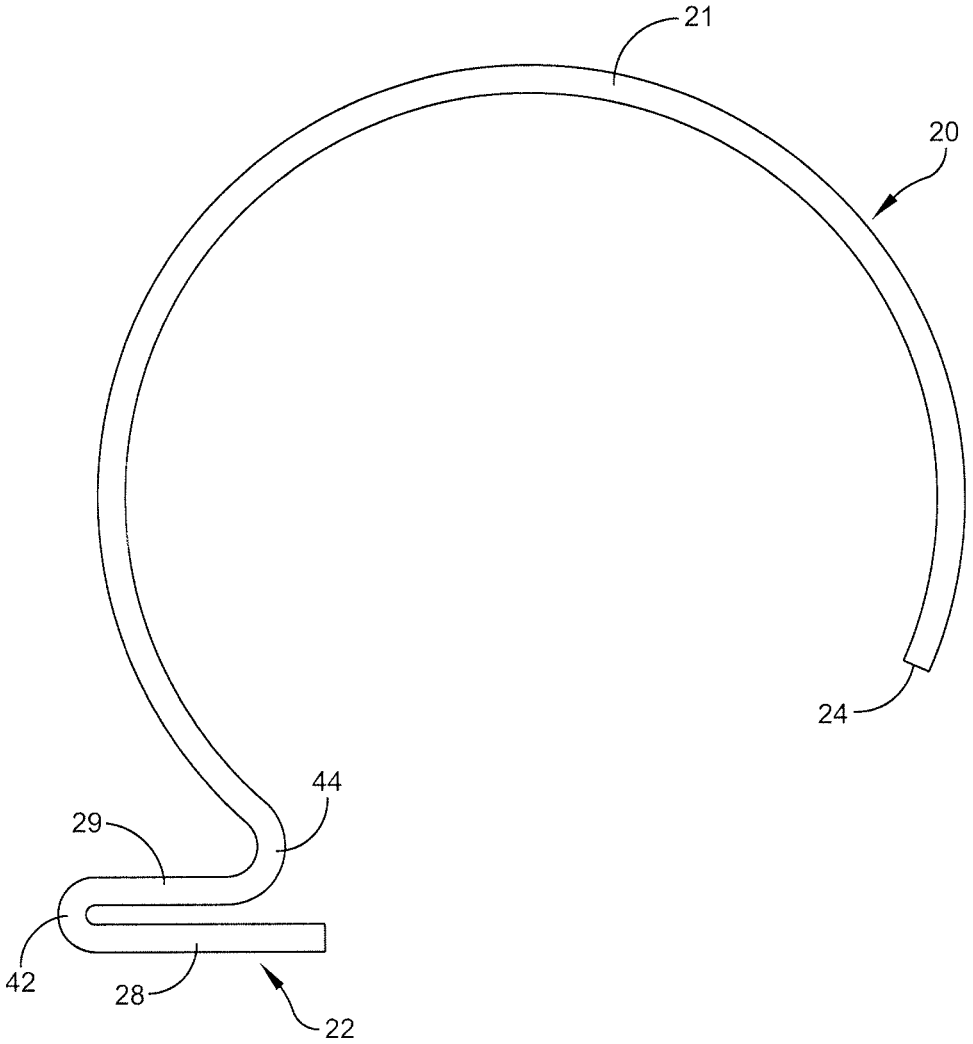
FIG. 7 is a side elevation view showing the coil clamp.
Figure 8:
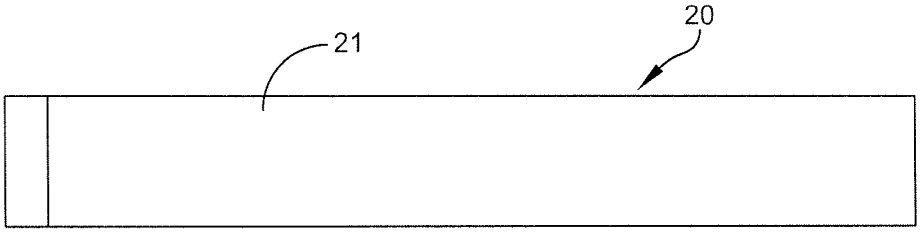
FIG. 8 is a top view showing the coil clamp.
Figure 9:
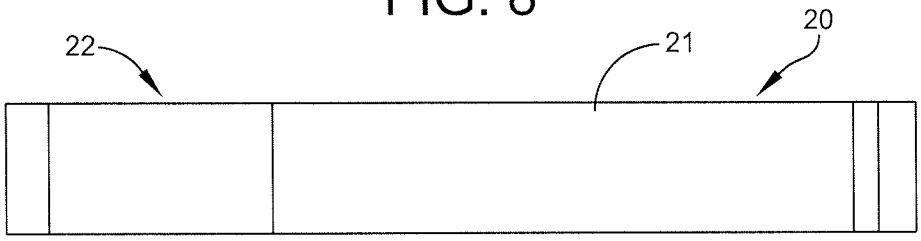
FIG. 9 is a bottom view showing the coil clamp.
Figure 10:
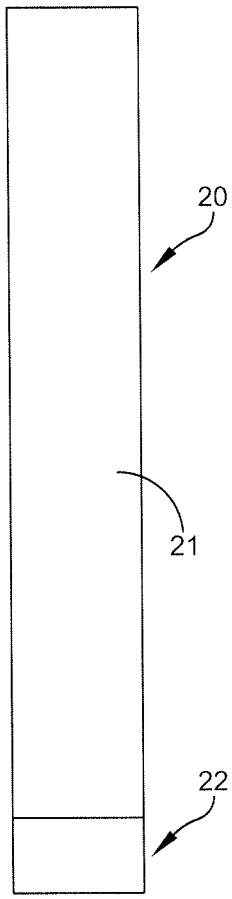
FIG. 10 is a left side view showing the coil clamp.
Figure 11:
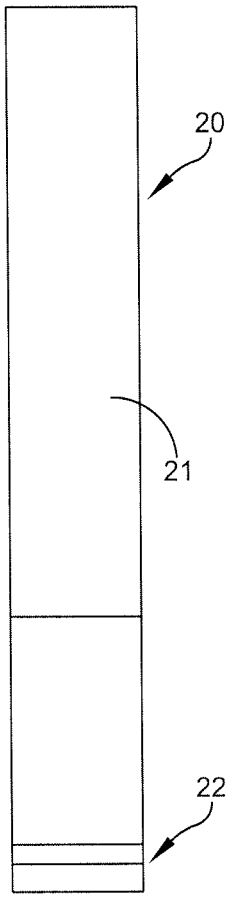
FIG. 11 is a right side view showing the coil clamp.
Figure 12:
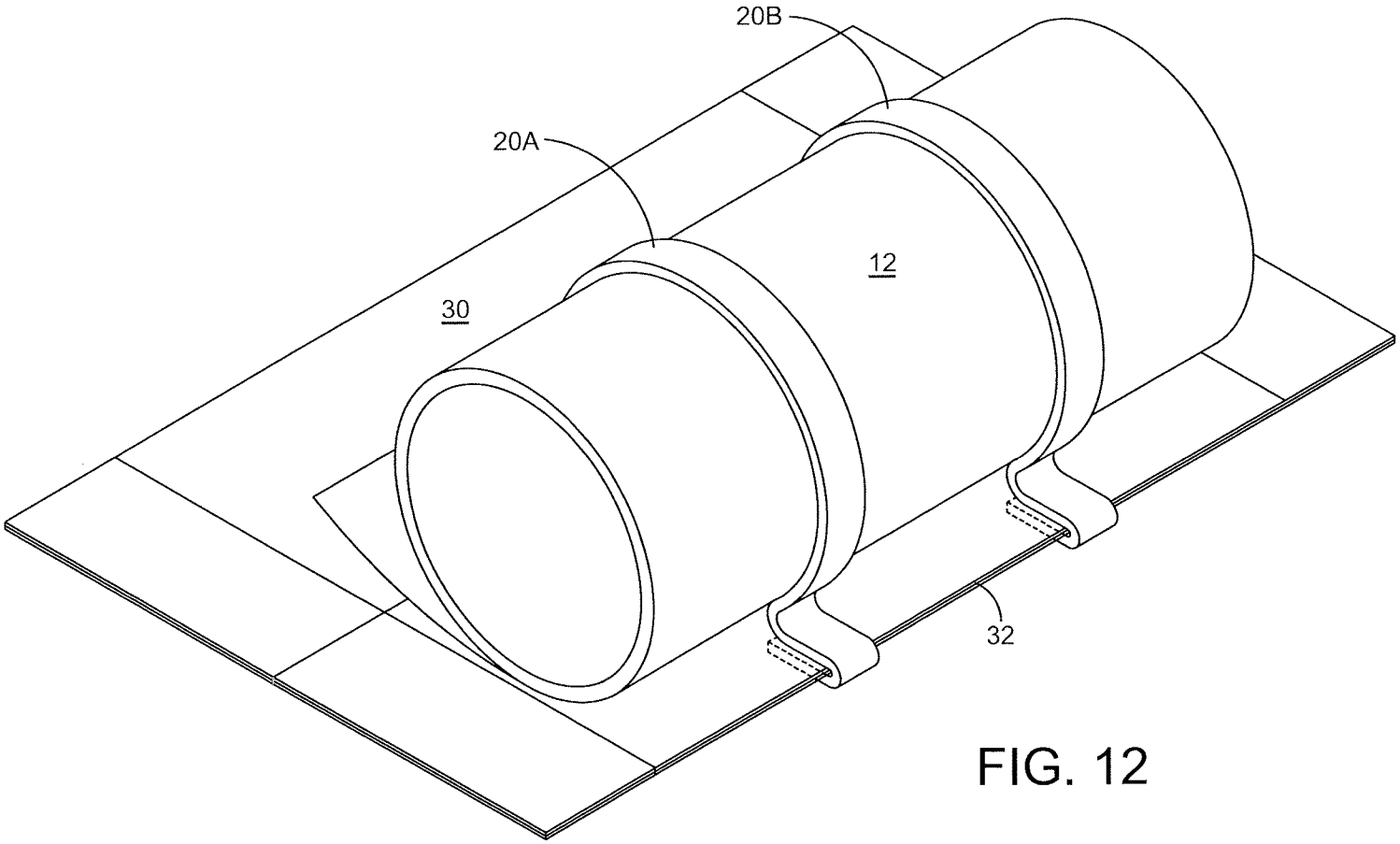
FIG. 12 illustrates the use of a pair of coil clamps in accordance with the present invention that are spaced apart and that provide some additional support for the metal coil.

The present invention provides for a device that is of simple construction and that is yet effective in holding the coil structure in position to thus enable a length of the coil structure to be withdrawn and separated from the remaining coil structure. Refer now to the drawings for an illustrative embodiment. FIG. 1 is a perspective view of the coil clamp of the present invention as positioned within the container box and about the metal coil structure. FIG. 2 is a perspective view of the metal coil having been removed from the container box with the coil clamp in position about the metal coil and with the container box flattened so as to be useable as a base substrate upon which the metal coil can be withdrawn and cut. FIG. 3 is a perspective view of the metal coil having been removed from the container box with the coil clamp in position about the metal coil, with the container box flattened so as to be useable as a base substrate upon which the metal coil can be withdrawn and cut, and also illustrating the coil clamp engaged with an edge of the base substrate. FIG. 4 is a perspective view taken from the opposite side with a section of the metal coil being withdrawn from the coil roll. FIG. 5 is a cross-sectional through the coil clamp as taken along line 5-5 of FIG. 4. FIG. 6 is a perspective view showing the coil clamp alone. FIG. 7 is a side elevation view showing the coil clamp. FIG. 8 is a top view showing the coil clamp. FIG. 9 is a bottom view showing the coil clamp. FIG. 10 is a left side view showing the coil clamp. FIG. 11 is a right side view showing the coil clamp. FIG. 12 illustrates the use of a pair of coil clamps in accordance with the present invention that are spaced apart and that provide some additional support for the metal coil.

Reference is now made to the drawings and in particular the drawings of FIGS. 1-11 that illustrate the device of the present invention at 10. The device 10 is for holding a coil structure 12 that is typically wound in multiple coils and is typically a metal coil that can be used in the construction or other business environment. The device 10 comprises a coil clamp 20 that retains the coil structure in association with a base substrate 30. In FIG. 1 there is shown a box construction at 31 that may be used for housing the coil structure and the coil clamp. FIG. 3 illustrates one form of the invention in which the box structure 31 may be flattened to form the substrate 30. As illustrated in, for example, FIG. 3, the coil clamp 20 engages with an edge 32 of the substrate 30. Rather than using the box structure illustrated in FIG. 1, other flat substrate structures may be used including those constructed of cardboard or plastic materials. FIG. 2 also shows the use of the D-ring D engaged with the base substrate engagement portion 22. This D-ring D prevents the coil clamp from sliding relative to the substrate. The D-ring D may be a closed loop or may use some other type of a clasp arrangement.

The coil clamp 20 is illustrated in a cross-sectional view in FIG. 5 and a perspective view in FIG. 6. The coil clamp 20 is formed as a single piece coil clamp that includes a main circular portion 21 and a base substrate engagement portion 22. The substrate engagement portion is contiguous with the main circular portion as illustrated in the cross-sectional view of FIG. 5. The base substrate engagement portion 22 is provided with a retaining recess 23 as depicted in FIG. 6. The recess 23 received and engages with the side edge 32 of the base substrate 30.

As indicated previously, the base substrate is a piece of planar material preferably having a thickness comparable to the width of the recess in the coil clamp. FIG. 5 illustrates the coil clamp engaging with the edge of the substrate. The planar material may be a cardboard material.

The main circular portion 21 of the single piece coil clamp has an end free edge 24. This end free edge of the main circular portion extends linearly such as depicted in FIGS. 4 and 6 and is disposed spaced above the base substrate when the retaining recess 23 is engaged with the edge 31 of the base substrate. The end free edge 24 of the main circular portion 21 is located opposite to the base substrate 30 as depicted in FIG. 5 and forms an open slot 25 through which an edge 26 of the coil structure can be withdrawn and unwinding the coil structure.

The base substrate engagement portion 22 is formed by opposite position legs that define the retaining recess 23 for receiving and engaging with the linear edge of the base substrate. The opposite position legs include an upper leg 27 that is contiguous with the main circular portion 21 and a lower leg 28 having a free end edge 29 that extends toward the end free edge 24 of the main circular portion 21.

The base substrate engagement portion 22 includes a first arcuate portion 42 integrally connecting the upper leg 27 and the lower leg 28; as well as a second arcuate portion 44 that integrally connects the upper leg 27 with the main circular portion 21. From the cross-sectional view of FIG. 5, it is noted that the first arcuate portion 42 turns in an opposite direction to that of the second arcuate portion 44. Also, the first arcuate portion 42 has a generally smaller radius of curvature than the radius of curvature of the second arcuate portion 44.

In FIGS. 1-11 a single coil clamp 20 is employed. For larger coils structures, it may be advantageous to provide a pair of coil clamps 20A and 20B as illustrated in FIG. 12. Each of these coil clamps is of the same dimension and engages with the same substrate edge 32.

Having now described a limited number of embodiments of the invention, it should now be apparent to those skilled in the art that numerous other embodiments and modifications thereof are contemplated as falling within the scope of the present invention, as defined by the appended claims. Although the principles of the present invention have been described in connection with supporting a metal coil it is understood that the coil clamp of the present invention may be used for the support of many different items.

What is claimed is:

1. A device for holding a coil structure that is wound in multiple coils, said device comprising a coil clamp that retains the coil structure and a base substrate that the coil clamp engages in order to support the coil clamp and, in turn, the coil structure, said coil clamp formed as a single piece coil clamp that includes a main circular portion and a base substrate engagement portion that is contiguous with the main circular portion, said main circular portion constructed and arranged for receipt of the coil structure, said base substrate engagement portion having a retaining recess for receiving and engaging with a side edge of the base substrate, wherein the main circular portion has an end free edge that extends linearly and is disposed spaced above the base substrate when the retaining recess is engaged with the side edge of the base substrate, and wherein the base substrate extends from the retaining recess linearly to a point below the end free edge of the main circular portion.

2. The device of claim 1 wherein the base substrate is a piece of planar material.

3. The device of claim 2 wherein the planar material is a cardboard material.

4. The device of claim 1 wherein the main circular portion of the single piece coil clamp has an end free edge.

5. The device of claim 1 wherein a length of the base substrate is at least as long as a length of the coil structure and a width of the base substrate is at least as wide as a width of the coil structure.

6. The device of claim 5 wherein the end free edge of the main circular portion is located opposite to the base substrate engagement portion and forms an open slot through which an edge of the coil structure can be withdrawn in unwinding the coil structure.

7. The device of claim 6 Wherein the base substrate engagement portion is formed by opposite position legs that define the retaining recess for receiving and engaging with the side edge of the base substrate.

8. The device of claim 7 wherein the opposite position legs include an upper leg that is contiguous with the main circular portion and a lower leg having a free end edge that extends toward the end free edge of the main circular portion.

9. The device of claim 8 wherein the base substrate engagement portion further includes a first arcuate portion integrally connecting the upper and lower legs and a second arcuate portion integrally connecting the upper leg and the main circular portion.

10. The device of claim 9 wherein the first arcuate portion turns in an opposite direction to the second arcuate portion.

11. The device of claim 10 wherein the first arcuate portion has a smaller radius of curvature than that of the second arcuate portion.

12. The device of claim 1 wherein the base substrate engagement portion is formed by opposite position legs that define the retaining recess for receiving and engaging with the side edge of the base substrate.

13. The device of claim 12 wherein the opposite position legs include an upper leg that is contiguous with the main circular portion and a lower leg having a free end edge that extends toward the end free edge of the main circular portion.

14. The device of claim 13 wherein the base substrate engagement portion further includes a first arcuate portion integrally connecting the upper and lower legs and a second arcuate portion integrally connecting the upper leg and the main circular portion, and wherein the first arcuate portion turns in an opposite direction to the second arcuate portion.

15. The device of claim 14 wherein the first arcuate portion has a smaller radius of curvature than that of the second arcuate portion.

16. The device of claim 1 in combination with a container box for initially holding the coil structure and wherein the coil structure is a metal coil structure.

17. The device of claim 16 wherein the container box is constructed of a cardboard material.

18. The device of claim 17 wherein a part, or all of the container box, is foldable and useable as the base substrate.

19. The device of claim 1 wherein the base substrate further has an edge opposite to the edge that engages with the recess and upon which an and edge of the coil structure lies to enable a cutting of the end edge of the coil structure at a location over the opposite edge of the base substrate.

20. The device of claim 1 wherein the base substrate engagement portion further includes a first arcuate portion integrally connecting the upper and lower legs and a second arcuate portion integrally connecting the upper leg and the main circular portion, Wherein the first arcuate portion turns in an opposite direction to the second arcuate portion, and wherein the first arcuate portion has a smaller radius of curvature than that of the second arcuate portion.

21. A device for holding a coil structure that is wound in multiple coils, said device comprising a coil clamp that retains the coil structure and a planar base substrate that the coil clamp engages in order to support the coil clamp and, in turn, the coil structure, said coil clamp formed as a single piece coil clamp that includes a main circular portion having an end free edge and a planar base substrate engagement portion that is contiguous with the main circular portion, said main circular portion constructed and arranged for receipt of the coil structure, said planar base substrate engagement portion having opposed legs that define therebetween a retaining recess for receiving and engaging with a side edge of the planar base substrate, wherein the end free edge of the main circular portion is disposed spaced above the base substrate when the retaining recess is engaged with the side edge of the planar base substrate.

22. The device of claim 21 wherein, when the side edge of the planar base substrate is engaged with the retaining recess, the planar base substrate extends continuously from the retaining recess to at least a location below the end free edge of the main circular portion.

23. The device of claim 12, wherein a length of the base substrate is at least as long as a length of the coil structure and a width of the base substrate is at least as wide as a width of the coil structure.

* * * * *